United States Patent [19]

Popovich et al.

[11] Patent Number: 4,795,319

[45] Date of Patent: Jan. 3, 1989

[54] QUIET HAIR DRYER

[76] Inventors: John M. Popovich, 2742 S. La Cienega, Los Angeles, Calif. 90034; Roc V. Fleishman, 432 ½ Alatair Pl., Venice, Calif. 90291

[21] Appl. No.: 931,255

[22] Filed: Nov. 17, 1986

[51] Int. Cl.[4] ..... F04B 39/00; F04B 35/04

[52] U.S. Cl. ..... 417/354; 415/119; 416/231 R

[58] Field of Search ..... 417/321, 352, 353, 354, 417/DIG. 1; 415/90, 119; 416/179, 184, 185, 231 R

[56] References Cited

U.S. PATENT DOCUMENTS

| | | | |
|---|---|---|---|
| 2,161,027 | 6/1939 | Dollinger | 181/200 |
| 2,731,194 | 1/1956 | Kent | 417/312 |
| 3,083,538 | 4/1963 | Gross | 416/179 X |
| 3,123,286 | 3/1964 | Abbott | 417/DIG. 1 |
| 3,127,092 | 3/1964 | Shenberger | 417/353 |
| 3,128,940 | 4/1964 | McDonald | 416/184 |
| 3,190,544 | 6/1965 | McDonald | 416/231 X |
| 3,362,627 | 1/1968 | Papst | 417/353 |
| 3,430,846 | 3/1969 | Gross | 417/353 |
| 3,540,547 | 11/1970 | Coward, Jr. | 181/50 |
| 3,723,781 | 3/1973 | Schnitzler, Jr. | 310/51 |
| 3,775,029 | 11/1973 | Ranz | 417/353 |
| 3,947,148 | 3/1976 | Holt | 415/119 |
| 4,230,279 | 10/1980 | Forsberg | 239/559 |
| 4,258,821 | 3/1981 | Wendt et al. | 181/202 |
| 4,279,325 | 7/1981 | Challis | 181/211 |
| 4,566,864 | 1/1986 | Yamamoto | 417/353 |
| 4,596,921 | 6/1986 | Hersh et al. | 219/370 |
| 4,669,951 | 6/1987 | Stern | 416/231 R |

*Primary Examiner*—Leonard E. Smith
*Assistant Examiner*—Eugene L. Szczecina, Jr.
*Attorney, Agent, or Firm*—William W. Haefliger

[57] ABSTRACT

A quiet hair dryer comprises:

(a) an air blowing rotor comprising open cell foam, (b) a motor connected in driving relation with the rotor, and (c) a housing to confine the rotor and forming air inlet and discharge passages to pass air to the rotor for passage through the rotor open cell foam as the rotor rotates, and to deliver the air from the rotor in a hair drying stream.

4 Claims, 3 Drawing Sheets

QUIET HAIR DRYER

BACKGROUND OF THE INVENTION

This invention relates generally to hair dryers; and more specifically it concerns low noise output, i.e. "quiet" hair dryers.

It is a well known fact that hair dryers that employ motor driven air blowers are quite noisy, which circumstance is correspondingly disturbing to users. Also, such appliances are bulky and not desirably or sufficiently compact so as to be easily carried in purses or handbags. There is need for improvements in hair dryer construction that will overcome these and other problems and difficulties.

SUMMARY OF THE INVENTION

It is a major object of the invention to provide a "quiet" hair dryer, having improved construction, which is highly compact and efficient. Basically the hair dryer comprises:

(a) an air blowing rotor comprising open cell foam, (b) a motor connected in driving relation with the rotor, and (c) means including a housing to confine the rotor and forming air inlet and discharge passages to pass air to the rotor for passage through the rotor open cell foam as the rotor rotates, and for delivering such air from the rotor in a hair drying stream.

As will appear, the open cell foam rotor is in annular form, with circular inner and outer sides, and air inlet structure is provided to be in communication with the foam rotor inner surface to supply air thereto for centrifugal pumping through foam interstices, this structure also contributing to sound "deadening", i.e. amplitude reduction.

A further object is to provide a compact electric motor radially inwardly of the foam rotor, the rotor of the electric motor directly connected to the foam air pumping rotor as by a strut or struts. Typically, there is an open annular air plenum radially inwardly of the open cell foam, and said air inlet structure includes two air inlets respectively at opposite sides of said annular plenum to flow air into said plenum from opposite sides thereof, for flow into the open cell foam via the circular inner surface thereof. The strut may advantageously take the form of a disc that divides the plenum into two sub-plenums at opposite sides of the disc, the sub-plenums respectively in communication with said two inlets. Accordingly, air is drawn into the plenums from opposite sides, and pumped outwardly by the foam rotor; and sound frequencies transmitted by the disc from the motor are deadened or attenuated in the foam.

These and other objects and advantages of the invention, as well as the details of an illustrative embodiment, will be more fuly understod from the following specification and drawings, in which:

DRAWING DESCRIPTION

DETAILED DESCRIPTION

Figure 2:
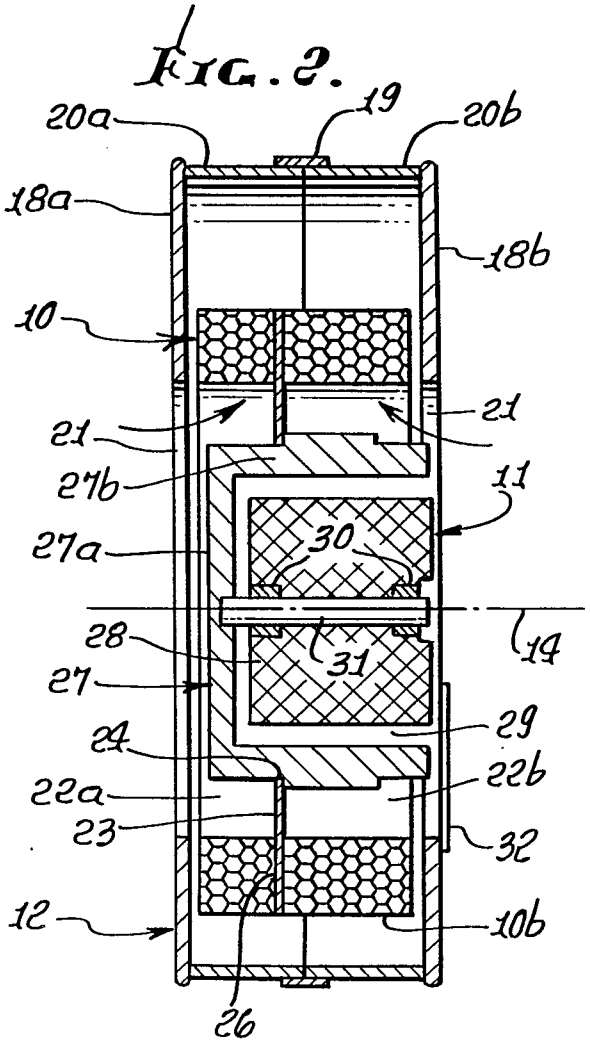
FIG. 2 is a vertical section taken on lines 2—2 of FIG. 1.
Figure 1:
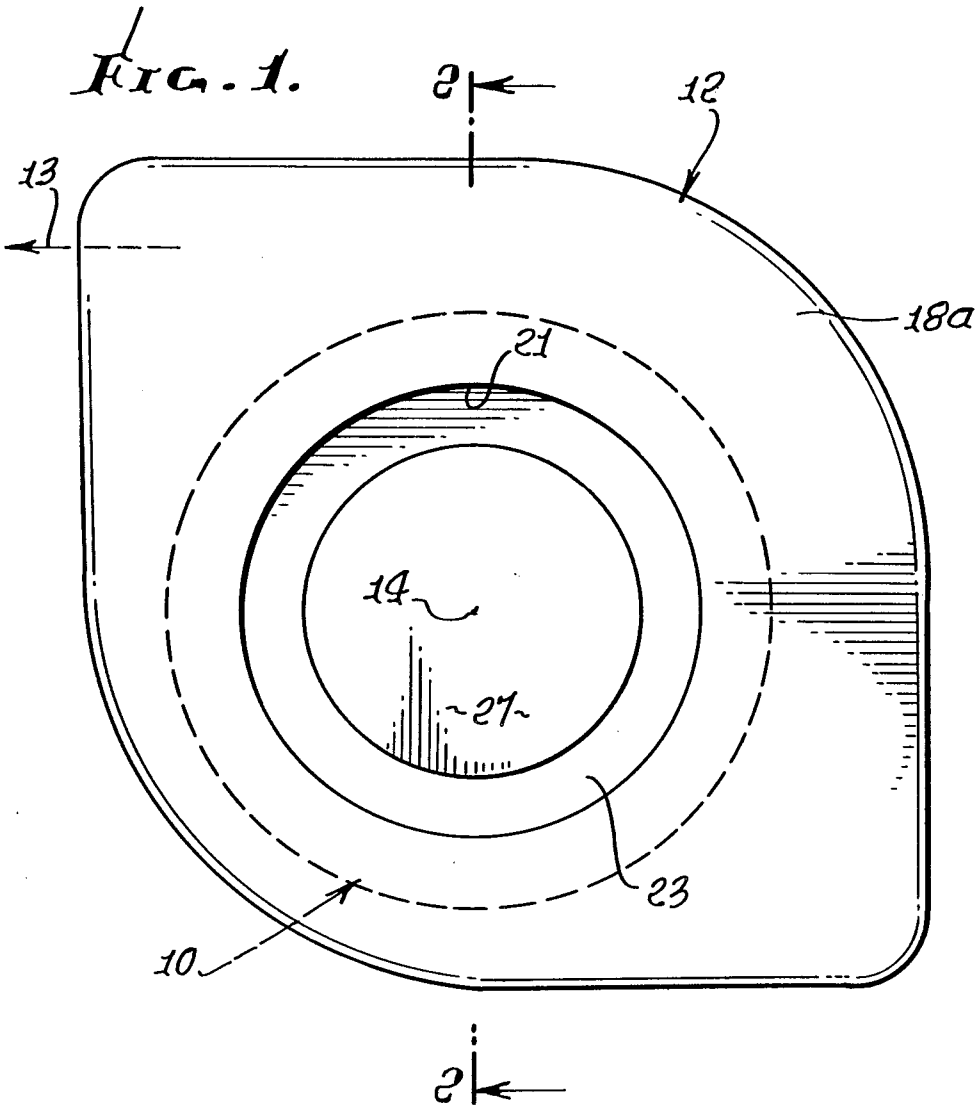
FIG. 1 is a left side elevation of apparatus incorporating the invention.
Figure 3:
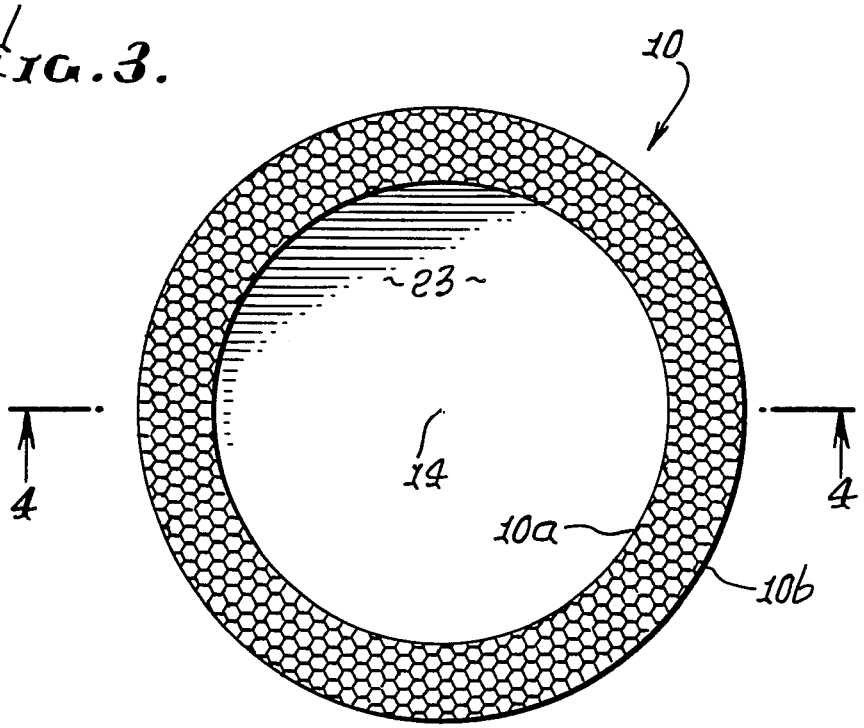
FIG. 3 is a side elevation showing an air blowing foam rotor.
Figure 4:
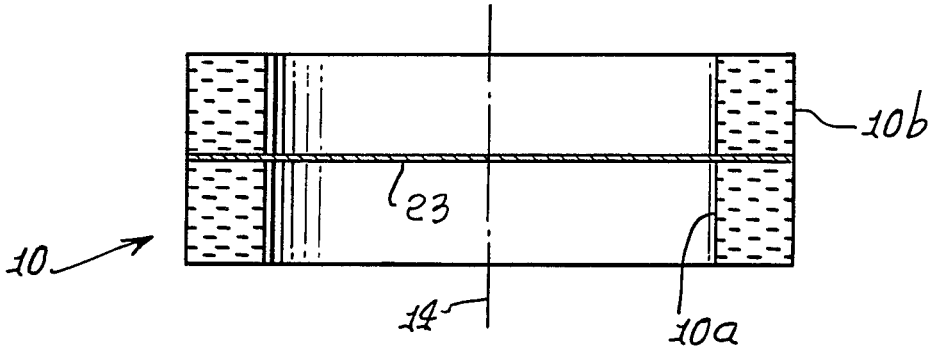
FIG. 4 is a section on lines 4—4 of FIG. 3.

In the drawings, a foam rotor is shown at 10, an electric motor at 11; and means is provided to include a housing 12, for containing the rotor and for forming air inlet and discharge passages to pass air to the rotor for passage through open cells of the foam as the rotor rotates, the air then being delivered from the rotor in a hair drying stream at 13.

Figure 5:
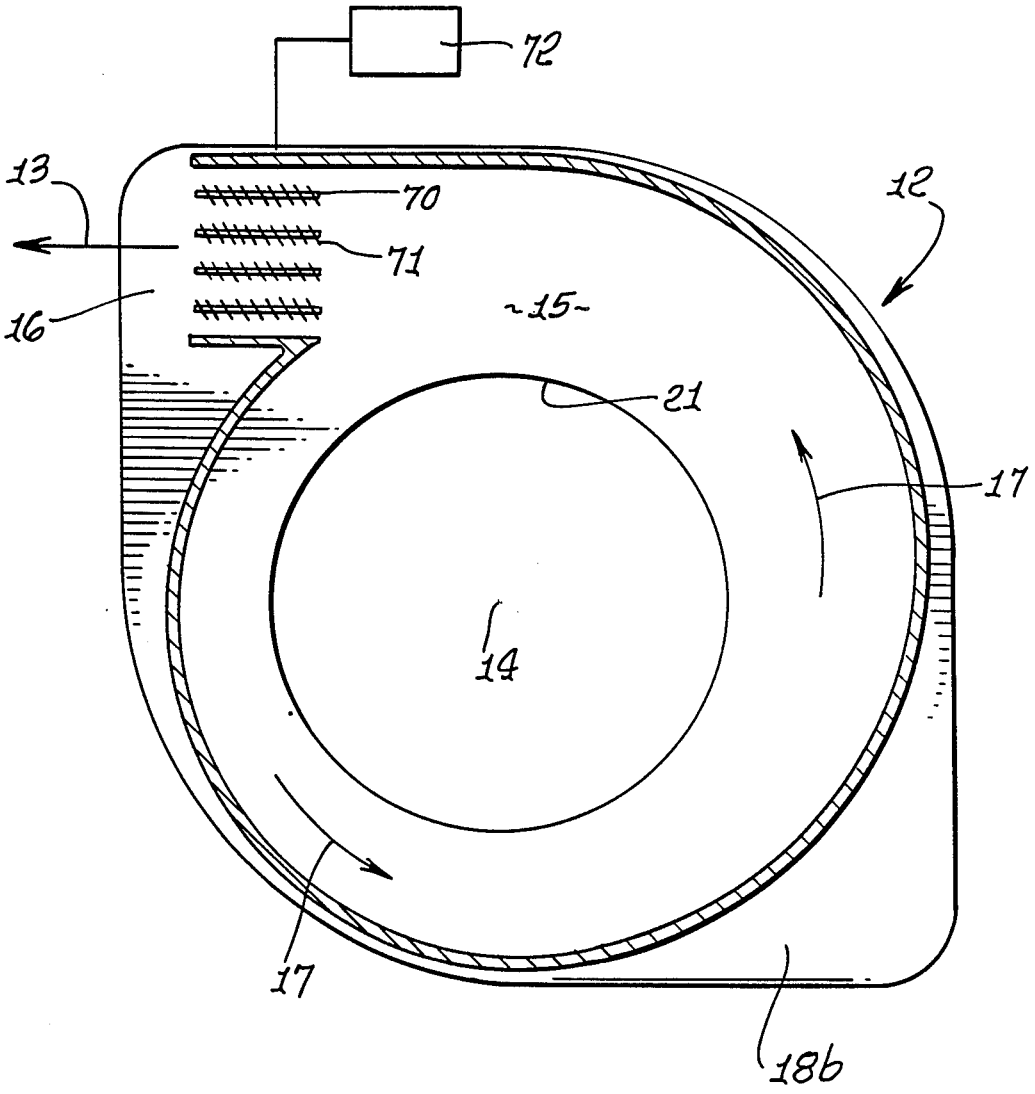
FIG. 5 is a section in elevation showing a housing side plate.

The rotor 10 acting as an air blower is annular; and has open cell foam construction; and it has a circular outer most surface **10*b* and a circular inner surface 10*a*. It may consist, for example, of air expanded polyurethane having small cells which are in open communication so as to pass air between surfaces 10a and 10*b*, in a radially outward direction. When rotated about axis 14 in the housing 12, and by motor 11, to be further described, it causes air flow outwardly through the rotor, for spiral flow through volute shaped discharge passage 15 seen in FIG. 5, to and through discharge outlet 16. See arrows 17 in FIG. 5. In this regard, passage 15 may be formed by two like, mirror image side plates 18*a* and 18*b*, fastened together as at 19, at the parting line between volute shaped walls 20*a* and 20*b*** integral with side plates of the housing.

Plates **18*a* and 18*b* extend in parallel relation, and define side air inlet openings 21 in lateral registration with one another. Those inlets also register with an open annular plenum formed as annular sections 22*a* and 22*b*, so that air flows from one opening 21 to plenum section 22*a*, and air flows from the other opening 21 to plenum section 22*b*. The plenum sections are both adjacent the inner annular surface 10*a* of the foam rotor, whereby air is drawn inwardly into the sections 22*a* and 22*b* for quiet outward flow through the foam rotor cells, to discharge into volute passage 15, and for flow as an air stream to discharge at 16**.

Plenum sections **22*a* and 22*b* are separated by a strut or struts 23 that extends or extend radially from a connection at 24 to motor rotor 27, to a connection at 26 to the foam rotor 10. The strut may for example comprise a thin, lightweight metal disc bonded at 26 to the interior of the foam rotor, for transmitting rotation to the foam rotor 10 and heat from the motor to the air. Thus, the disc may consist of aluminum or aluminum alloy. The motor rotor 27 is cup-shaped, with end wall 27*a* and annular wall 27*b* both located radially inwardly of the foam rotor 10, to provide a simple, compact assembly. The motor stator 28 is received in the interior space 29 defined by the cup-shaped rotor 27, and may carry bearings 30 mounting the motor rotor shaft 31 for rotation. Suitable spokes 32 or other connection means, may attached the stator 28 to one side plate 13, as shown, such spokes being annularly separated (or forming air passages) to allow air flow to the side inlet 21 communicating with plenum section 22*b*. Note that the motor rotor and stator are confined between planes defined by the side plates 13**, whereby a highly compact, efficient, and easily hand-held assembly is provided, the device operating with minimum sound production. It may be made in very small size, for reception into a women's purse, or handbag.

The foam in the rotor 10 is cured and not "spongy". Heater wires 70 may be incorporated with flow straightening vanes 71, and an electric current source appears at 72.

Strut 23 also transmits motor heat to the air, for cooling the motor.

We claim:

1. In a quiet hair dryer, the combination comprising:

(a) an air blowing rotor comprising open cell foam, which is cured, the foam consisting of air expanded polyurethane, (b) an electric motor connected in driving relation with the rotor, the motor including a cup-shaped rotor having an annular outer wall and an end wall, and a stator located in the cup-shaped motor rotor and defining an axis, said cup-shaped rotor outer wall spaced radially inwardly of said foam rotor, (c) means including a housing to confine the foam rotor and forming air inlet and discharge passages to pass air to the foam rotor for passage through the rotor open cell foam as the rotor rotates, and for delivering said air from the foam rotor in a hair drying stream, (d) said open cell foam being in annular form, and having a circular outer surface, and a circular inner surface, said means defining an air inlet structure in communication with the inner surface of the open cell foam, (e) there being an open annular air plenum radially inwardly of the open cell foam rotor and said air inlet structure including two air inlets respectively at axially opposite sides of said annular plenum to flow air into said plenum from opposite sides thereof, for flow into the open cell foam via said circular inner surface thereof, (f) and a thin disc mounted on said outer wall to extend normal to said axis, and extending in said plenum and transmitting rotary drive from the motor rotor to said open cell foam rotor, the disc having opposite outer faces to which said open cell foam is connected, said outer faces of the disc being solely connected by bonding of the disc to the open cell foam rotor, said disc dividing said plenum into two sub-plenums at opposite sides of the disc, the sub-plenums respectively in communication with said two inlets, and said disc consisting of aluminum alloy to transmit heat from the motor to air flowing in said sub-plenums, the disc having opposite side portions in direct axial registration with said two air inlets so that air flowing through said inlets contacts said disc opposite side portions to receive heat transfer therefrom, (g) and wherein the motor rotor extends about the rotor stator, said two inlets defining two substantially parallel planes between which said foam, disc motor rotor and motor stator are confined.

2. The combination of claim 1 wherein the rotor defines an axis, the air inlet structure including two parallel plates extending in planes normal to said axis, the open cell foam closely confined by and between said plates, the housing defining a volute shaped outer wall extending about said axis and spaced outwardly of said open cell foam, said wall connected to said plates, the plates defining said two air inlets, the stator connected to one of said plates.

3. The combination of claim 2 including spokes extending between one end of the stator and said one plate to connect the stator to said one plate, the spokes being annularly separated, there being an axially extending shaft carried by the rotor and supported to rotate by bearing means carried by the stator.

4. The combination of claim 2 wherein said one end of the stator is axially openly exposed to the exterior of the hair dryer via one of said air inlet openings, and said cup-shaped rotor is axially openly exposed to the exterior of the hair dryer via the other of the air inlet openings.

* * * * *